United States Patent [19]

Fickeisen et al.

[11] 4,122,219

[45] Oct. 24, 1978

[54] FLOCKING OF TEXTILE SHEET MATERIALS

[75] Inventors: Peter Fickeisen, Dirmstein; Gert Elschnig, Ludwigshafen; Hanns-Dietmar Haertl, Bruehl; Kurt Wendel; Klaus Eisentraeger, both of Ludwigshafen, all of Fed. Rep. of Germany

[73] Assignee: BASF Aktiengesellschaft, Ludwigshafen, Fed. Rep. of Germany

[21] Appl. No.: 574,231

[22] Filed: May 5, 1975

[30] Foreign Application Priority Data

May 14, 1974 [DE] Fed. Rep. of Germany ..... 2423284

[51] Int. Cl.[2] ..... B05D 1/14; B05D 1/16; B05D 1/36

[52] U.S. Cl. ..... 427/206; 427/26; 427/314; 427/316; 427/372 R; 428/90

[58] Field of Search ..... 427/200, 206, 316, 26, 427/372 R, 314; 428/90

[56] References Cited

U.S. PATENT DOCUMENTS

| | | | |
|---|---|---|---|
| 2,199,752 | 5/1940 | Oglesby | 427/200 X |
| 2,567,327 | 9/1951 | Ewing | 427/206 |
| 2,715,074 | 8/1955 | Hirsch berger | 427/206 X |
| 2,772,181 | 11/1956 | Rogers et al. | 427/200 X |
| 3,029,156 | 4/1962 | Keene | 427/206 X |
| 3,262,128 | 7/1966 | Morgan et al. | 427/206 X |
| 3,336,149 | 8/1967 | Fox et al. | 427/206 X |
| 3,529,986 | 9/1970 | Kappas et al. | 427/26 |
| 3,754,960 | 8/1973 | Hart | 427/204 |
| 3,922,410 | 11/1975 | Halloran | 427/206 X |

*Primary Examiner*—Shrive P. Beck

*Attorney, Agent, or Firm*—Keil, Thompson & Shurtleff

[57] ABSTRACT

In the manufacture of flocked textiles by applying a polymer emulsion, flocking and drying, a heat-sensitized polymer emulsion is used and the emulsion coat is first only gelled, by heating, in the zone adjoining the textile substrate, and is then flocked and dried at an elevated temperature.

6 Claims, 1 Drawing Figure

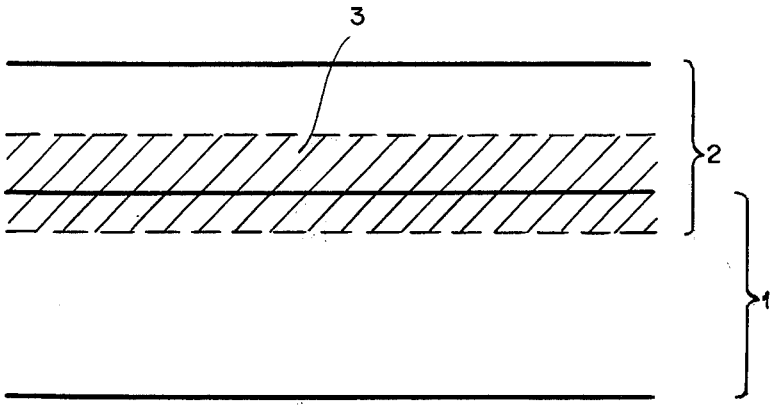
3
2
1

FLOCKING OF TEXTILE SHEET MATERIALS

BACKGROUND OF THE INVENTION

It has long been known that textile sheet materials such as woven fabrics, knitted fabrics or non-wovens, can be provided with a fine pile of fibers by first applying a thin coat of an aqueous polymer emulsion which generally contains a thickener and acts as an adhesive, then uniformly applying the fibers onto the emulsion coat, usually in such a way that one end of each fiber sticks in the emulsion coat, and then drying the material. Fibers which may be used for flocking are above all of viscose, cellulose or synthetic, fiber-forming polyamides which, as in the case of polyhexamethylene adipamide and polycaprolactam, contain recurring -NH-groups as constituents of their chain molecules. The fibers are generally applied electrostatically, for which purpose they are accelerated, in an electric field, toward the adhesive coat and virtually shot into the latter. The fibers can also be applied mechanically, for example by means of a vibrating screen or by blowing in a stream of air, but this gives felt-like flock coatings.

However, these conventional flocking processes require that the adhesive employed should be a polymer emulsion of relatively high viscosity to prevent excessive penetration of the adhesive into the textile. This presents difficulties in applying, and feeding, the emulsion and furthermore the hand of the flocked products obtained by this process is in most cases insufficiently textile-like.

SUMMARY OF THE INVENTION

We have found that textile sheet materials can be manufactured with advantage by application of a thin layer of an aqueous polymer emulsion, subsequent flocking and drying of the flocked substrate at elevated temperatures of up to about 200° C, by a method wherein a thin layer of a heat-sensitized aqueous polymer emulsion is applied to the textile substrate and is gelled, simultaneously with, or subsequent to, its application, in the zone which adjoins the textile substrate, by heating the latter in such a way that the zone remote from the textile substrate does not gel, and the product is flocked by conventional methods and then dried at elevated temperatures.

DESCRIPTION OF THE DRAWING

The single FIGURE of the drawing is a partly schematic cross-sectional view of a portion of a textile substrate coated with an aqueous polymer emulsion and partially gelled according to the process of the invention.

DETAILED DESCRIPTION OF THE INVENTION

The starting materials for the new process may be the flat substrates conventionally used for flocking, eg. woven fabrics, knitted fabrics and non-wovens, which may be manufactured from natural or synthetic fibers, eg. from cellulose, viscose staple, polycondensation products of alkylenediamines, such as, in particular, hexamethylenediamine, octamethylenediamine, 1, 4-diaminocyclohexane or decamethylenediamine, with aliphatic dicarboxylic acids, such as, in particular, adipic acid and sebacic acid, and/or of caprolactam, polyacrylonitrile, polyethylene glycol terephthalate, polyethylene and/or polypropylene.

The polymers wth adhesive properties present in the aqueous polymer emulsions which are used for coating the flat substrates also effectively do not differ from the polymers contained in the emulsions employed for conventional flocking processes. In general, however, polymer emulsions which have a lower viscosity than would be required for the conventional flocking processes may be employed in the new process. Whilst a lower viscosity of the polymer emulsions is not essential, smaller amounts of added conventional thickeners, such as methylcellulose, in most cases suffice. In some cases it is even not necessary to add thickeners to the aqueous polymer emulsions. The aqueous polymer emulsions which may be used for the process and which give polymer films which are tacky at room temperature may be manufactured by conventional methods, using the conventional amounts of emulsifiers and/or dispersing agents. The polymers are in most cases derived from acrylic acid and/or methacrylic acid esters of alkanols of 1 to 12, especially of 1 to 8, carbon atoms, in particlar ethyl acrylate, n-butyl acrylate, iso-butyl acrylate, 2-ethylhexyl acrylate and methacrylate and n-butyl methacrylate, and frequently contain minor amounts of comonomers with polar groups, eg., $\alpha,\beta$-olefinically unsaturated monocarboxylic acids and/or dicarboxylic aicds, in most cases of 3 to 5 carbon atoms, in particular acrylic acid, methacrylic acid, crotonic acid, itaconic acid or maleic acid or their amides or N-alkoxyamides, in particular acrylamide, methacrylamide, N-methylolacrylamide and/or N-methylolmethacrylamide, and from about 10 to 30% by weight of vinyl acetate, styrene and/or acrylonitrile, as copolymerized units. Butadiene copolymers of, in general, from 30 to 60 percent by weight of styrene and/or acrylonitrile and from 40 to 70 percent by weight of butadiene, which may contain small amounts, eg. from 0.5 to 5, especially from 1 to 3, percent by weight of monomers containing polar groups, such as $\alpha,\beta$-monoolefinically unsaturated monocarboxylic and/or dicarboxylic acids, mostly of 3 to 5 carbon atoms, such as acrylic acid, methacrylic acid, crotonic acid or itaconic acid and/or their unsubstituted or alkoxy-substituted amides of the abovementioned type, as copolymerized units, are also very suitable. Further aqueous polymer emulsions which may be used are those of ethylene/vinyl acetate copolymers in which the molar ratio of ethylene to vinyl acetate is from 20:80 to 70:30 . The copolymers in general have glass temperatures below 30° C and in most cases below 20° C. Anionic and/or non-ionic emulsifiers which may be used for the manufacture of suitable polymer emulsions are described in detail, for example, in Houben-Weyl "Methoden der Organischen Chemie", volume XIV/1, Macromolecular Substances, Georg Thieme Verlag, Stuttgart 1961, pages 192 to 208. However, in contrast to the polymer emulsions which are suitable for conventional flocking processes, the emulsions suitable for the new process should be heat-sensitive, ie, they should gel as rapidly as possible at elevated temperatures, which are in most cases above 40° C. Examples of heat-sensitizers which may be used in the polymer emulsions are poly(-vinyl alkyl ethers) according to German Pat. No. 869,861 which specifically discloses the use of polyvinyl methyl ether and also a copolymer of vinyl methyl ether and ethyl glycol vinyl ether, and German Published Application No. 1,569,119, (U.S. 3,437,509) water-soluble polyacetals according to German Printed Application No. 1,066,734, (U.S. 3,062,768) oxyalkylated polysiloxanes according to British Pat. No. 1,206,036, German Pat. No. 1,243,394 (U.S. Pat. No. 3,506,605) and German Published Application No. 2,005,974, (British No. 1,284,064), cationic substances according to German Published Application 1,619,049 (British No. 1,230,640), German Published Application Nos. 1,619,050 (no English language equivalent and German Published Application No. 1,948,301 (Canadian No. 909,981) and, particularly advantageously, oxyalkylated amines with inverse solubility characteristics, according to German Printed Application No. 2,226,269, (British No. 1,422,873), Swiss Pat. No. 554,910 (British No. 1,422,873) and German Published Application Nos. 2,408,302 (British No. 1,463,118) and 2,414,428 (Australian No. 74/67 354). The oxyalkylated amines may be derived from monofunctional or polyfunctional amines which in general have from 1 to 10, preferably from 1 to 3, amino groups. Amines with 2 amino groups are of particular interest; the amino groups of the oxyalkylated amines may be primary, secondary or tertiary. Preferably, the oxyalkylated amines are derived frm aliphatic amines, especially from polyfunctional aliphatic amines, such as ethylenediamine, diethylenetriamine, dipropylenetriamine, triethylenetetramine and tetraethylenepentamine, or from ethanolamine, diethanolamine and triethanolamine, ethylenediamine being of particular interest. Furthermore, the oxyalkylated amines are in particular derived from ethylene oxide and/or propylene oxide. Particularly suitable heat-sensitizers are random polyaddition products of from 10 to 30 moles of ethylene oxide and from 30 to 60 moles of propylene oxide with 1,2ethylenediamine, which in general have molecular weights of from 200 to 15,000, preferably from 800 to 6,000, and cloud points, in 1% strength aqueous solution, which are preferably from 40° to 90° C, especially from 40° to 60° C. Polyaddition products of 1,2ethylenediamine in which the molar ratio of ethylene oxide to propylene oxide is from 1:1 to 1:5 are of particular interest.

If polymer emulsions containing oxyalkylated amines with inverse solubility characteristics are employed, the emulsions as used for the new process preferably have a pH of less than 6, in most cases less than 4 and in particular from 1 to 3. The polymer content of suitable emulsions used in the new process is in most cases from 20 to 65 percent by weight, in particular from 40 to 60 percent by weight, based on the emulsion. If the heat-sensitized polymer emulsions contain oxyalkylated amines of inverse solubility characteristics as sensitizers, the content of such amines is in most cases from 1 to 20 percent by weight, preferably from 2 to 20 percent by weight, based on the polymers.

The heat-sensitive aqueous polymer emulsions may be applied to the flat textile substrates by conventional methods, using a coater employing a doctor blade or rollers, or by spraying. In general, suitable amounts to apply have proved to be from 250 to 400 g, especially from 300 to 350 g, of adhesive per square meter of substrate.

In the new process, the emulsion coat should be heated, through the flat substrate, so that the coat gels near the surface of the substrate without gelling of the zone of the coat which is remote from the textile substrate. In general it suffices if a few percent, eg. from 5 to 10%, of the thickness of the coat are gelled by heating through the flat substrate, but it is also possible to gel up to 80%. However, complete gelling of the coat must be avoided since otherwise adequate anchoring of the fibers is no longer possible. This is made clear in the appended drawing. This shows a section through a flat textile substrate coated with an aqueous polymer emulsion. (1) is the substrate, (2) the emulsion coat which has partially penetrated into the substrate and (3) the part of the coat which has gelled after exposure to heat through (1).

The coat may be heated, eg. by applying the heat-sensitized aqueous polymer emulsion to an adequately preheated flat textile substrate. However, it is also possible first to apply the heat-sensitized aqueous polymer emulsion to the flat substrate and then to heat it through the flat substrate, eg. by using infrared radiators, hot air, hot rollers or a heated conveyor belt. In order to achieve gelling of the coat in the stated zone, it is necessary that the amount of heat transferred through the flat substrate to the coat should suffice to heat the coat, within the desired thickness, to the temperature at which gelling occurs. This temperature, and accordingly the amount of heat required, depends on the sensitizer used and varies from case to case. Sensitizers which cause gelling at from about 40° to 90° C, preferably at from 40° to 60° C, are used in most cases.

Following the partial gelling of the coat, the coated flat substrate may be flocked by conventional methods, preferably by the electrostatic flocking process; the fibers conventionally used for flocking flat structures, which generally are from 0.1 to 20 mm long, in particular from 0.3 to 3 mm long, and have from 15 to 3 deniers, may be employed here also.

The flocked flat textile substrate may then be dried by conventional methods at elevated temperatures which may be up to about 200° C and are in most cases from 140° to 160° C.

The new flocking process gives textile sheet materials which are flocked, ie, have a pile, and exhibit a particularly pleasant handle; strike-through of the emulsion coat through the substrate does not take place. Furthermore, the new flocking process presents few difficulties and problems when applying the emulsion of binder polymer, since emulsions of relatively low viscosity may be employed.

EXAMPLE

A cotton web weighing 300 g/m$^2$ is heated to 100° C on a heated roller. At a distance of 50 cm from the roller, the web leaving the roller is knife-coated with a 45% aqueous anionic dispersion of a copolymer of 25% w/w, based on the copolymer, of acrylonitrile, 70% w/w butadiene, 4% w/w N-methylol acrylamide and 1% w/w methacrylic acid containing 5% w/w of an ethylenediamine oxyalkylated with a mixture of propylene oxide and ethylene oxide and having a pH of 3.5, the rate of application being 300 g/m$^2$. The web is then immediately flocked in the usual manner in an electric field of 60,000 volts with 1-mm fibers of 1 dtex and dried at 150° C.

A flocked material is obtained which shows no strike-through of the polymer emulsion and has a soft, textile-like hand.

We claim:

1. In a process for flocking textile substrate by applying a thin layer of an aqueous polymer emulsion to the substrate, flocking, and subsequently drying the flocked substrate at an elevated temperature of up to 200° C, the improvement which comprises applying a thin layer of a heat-sensitized aqueous polymer emulsion to the textile substrate and, simultaneously with its application or immediately thereafter, gelling the emulsion coat in its zone adjoining the textile substrate by heat applied from the textile substrate, in such a way that the zone remote from the textile substrate does not gel, and then flocking the substrate and subsequently drying the flocked substrate at elevated temperatures.

2. A process as claimed in claim 1 wherein the aqueous polymer emulsion contains as heat sensitizer an oxyalkylated amine with inverse solubility characteristics.

3. A process as claimed in claim 2 wherein the oxyalkylated amine is a polyfunctional aliphatic amine oxyalkylated with a compound selected from the group consisting of ethylene oxide and propylene oxide.

4. A process as claimed in claim 2 wherein the aqueous polymer emulsion has a pH of less than 4 and contains 2 to 10 percent by weight of oxyalkylated amine based on polymer.

5. A process as claimed in claim 1 wherein the emulsion coat is gelled through a minor proportion of its thickness.

6. A process as claimed in claim 1 wherein the zone of the emulsion coat to be gelled is heated to from 40° to 60° C.

* * * * *